United States Patent [19]

Wildhagen

[11] 4,124,911

[45] Nov. 14, 1978

[54] RELEASE DEVICE FOR EMERGENCY SEA RESCUE APPARATUS

[75] Inventor: Birgitt I. Wildhagen, Hamburg, Fed. Rep. of Germany

[73] Assignee: Dunlop Limited, England

[21] Appl. No.: 776,668

[22] Filed: Mar. 11, 1977

[30] Foreign Application Priority Data

Mar. 13, 1976 [DE] Fed. Rep. of Germany ..... 760782

[51] Int. Cl.[2] ..... B63B 23/00

[52] U.S. Cl. ..... 9/33

[58] Field of Search ..... 9/3, 9, 11 R, 11 A, 9/14, 30–33, 44; 114/16.4, 16.5, 16.7

[56] References Cited

U.S. PATENT DOCUMENTS

| | | | |
|---|---|---|---|
| 3,343,188 | 9/1967 | Tuck | 9/33 |
| 3,534,418 | 10/1970 | Adams, Jr. | 9/33 |

*Primary Examiner*—Trygve M. Blix
*Assistant Examiner*—Jesus D. Sotelo
*Attorney, Agent, or Firm*—Stevens, Davis, Miller & Mosher

[57] ABSTRACT

A release device for an emergency sea rescue apparatus includes a water pressure release mechanism whereby a lifecraft can be automatically released if its parent ship sinks, the device being designed to accommodate forces at any angle between the normal horizontal and vertical direction whereby the release will operate without jamming regardless of the angle of the ship's deck when the release is triggered.

9 Claims, 8 Drawing Figures

FIG.7
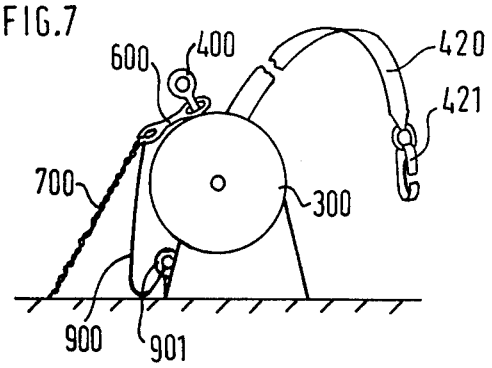
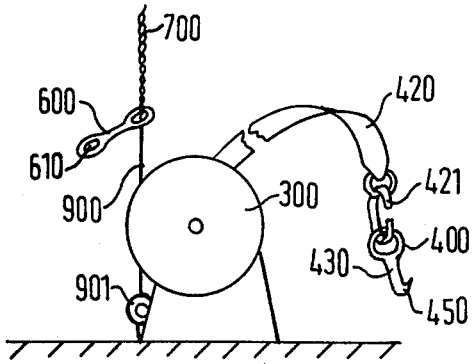
FIG.8

RELEASE DEVICE FOR EMERGENCY SEA RESCUE APPARATUS

The invention relates to a release device for an emergency sea rescue apparatus, which apparatus consists of an emergency rescue craft (liferaft) mounted on a ship, an eye hook with a belt strap attached to it to fasten the rescue craft on to the ship, a water pressure release device which releases the eye hook when a predetermined water pressure is reached, where said release device includes a rope (painter), one end of which is attached to the ship and the other end of which is connected to the rescue vessel.

The practical requirements for emergency sea rescue apparatus necessitate precautions, on the one hand to secure the rescue craft safely on the deck of a ship when not in use and, on the other hand, to make the rescue craft available for use even when no time is available for undoing fixing straps or lines.

In the case of a sea rescue in which the ship's crew has sufficient time to reach the rescue craft, to undo the attachment straps and lines and to drop the rescue craft on to the water no special problems arise as a rule. But, even without the crew having to carry out any operations, the rescue craft must, in any case, release itself from the sinking ship even when the attachment strap has not been undone so as to prevent the rescue craft from sinking with the ship. For this purpose a water pressure release (hydrostatic release unit) is used and the attachment strap of the rescue craft is fixed to it. (A suitable water pressure release device is decribed in British Patent specification No. 907,001). When the sinking ship reaches a certain depth the water pressure release mechanism responds and the connection between the rescue craft and the ship is broken. Thus the rescue craft can float upwards and can be boarded by the crew. Even in this case the rescue craft still remains connected to the ship at first so as to make it possible for those members of the crew in the proximity of the ship to reach the rescue craft. This connection is produced by a so-called painter. But this connection between the floating rescue craft and the sinking ship cannot remain in being for an unlimited time but must, at the latest, be broken when the ship has sunk to such a depth that the painter is in tension and the danger thus exists that the sinking ship will drag the rescue craft down with it to the bottom. The strength of the painter is therefore selected in such a way that it breaks when a certain tensile force is reached. The choice of the limiting strength of the painter is difficult since, on the one hand, it should have sufficient strength to maintain a connection between the rescue craft and the ship, even in heavy weather, for a certain time while on the other hand its strength should not be greater than a certain value for the reasons discussed above. In addition it is disadvantageous if the painter cannot be used for recovery of the rescue craft after it has broken because of its low strength. Also added to this is the fact that the point at which the painter breaks may be more or less distant from the rescue craft so that the piece remaining for recovery is in any case too short.

The basic object of the invention is to provide an improved release mechanism of the general type described in the introduction which will meet the needs of the most serious emergencies at sea. During use of the improved emergency sea rescue apparatus the certainty with which the rescue craft can serve the purpose intended for it during sinking of a ship will also be increased. In addition it will be ensured that a line is available on the rescue craft which is also suitable for recovery purposes.

According to the invention this object is achieved in that, on the end nearest the ship, the painter is attached to a water pressure release device, in particular to the water pressure release device for the attachment strap of the rescue craft, instead of being attached to the deck of the ship itself, this latter arrangement being conventionally used prior to this invention.

This arrangement is, however, not easily possible since considerable forces are transmitted through the painter between the rescue craft and the ship and these must be absorbed in such a way that the water pressure release device can still operate as a release. It must be observed here that known water pressure release devices have a release mechanism which can operate only when it is loaded with upwardly-directed forces. It must also be observed that, if it is loaded with lateral forces or is clamped, the hook of the known water pressure release mechanism cannot be moved at all and is thus unable to operate as a release. Thus the forces originating from the painter cannot be accepted by the hook of a known water pressure release mechanism, since it would then only be certain that the water pressure release mechanism would actually operate as a release in special cases. It should be appreciated that the forces in the painter may act in the horizontal and vertical directions at an angle between 0° and 180° and that at most a small component of these forces will act in the vertical direction on the hook of the water pressure release mechanism in many instances.

Thus, according to the invention, the eye hook of the release device is mounted to pivot about a bearing point so that the forces in the painter are not transmitted directly to the eye hook but through a clamping shackle. In this case the clamping shackle ensures that, even when the forces in the painter are directed upwards, deflection of the forces in the painter relative to the forces acting on the hook of the water pressure release mechanism occurs. In the more usual case in which the forces in the painter act in the downward direction these forces act immediately above the point of pivoting or bearing point of the eye hook so that only a relatively small force acts on the hook of the release mechanism, certain release being ensured through the upward-directed component of this force.

According to another form of embodiment of a release device according to the invention, the clamping shackle has an eye with an eye aperture which is smaller than the external measurements of the eye of the eye hook. It is thereby ensured that the clamping shackle cannot be drawn over the eye of the eye hook. However, if the eye hook is released by the water pressure release mechanism the shaft of the eye hook together with its shoulder are able to pass through the eye aperture on the clamping shackle and thus release the painter.

By virtue of the improved, strengthened release mechanism of the invention it is possible to utilise painters of considerably increased strength attached directly to the hydrostatic release unit.

It was previously common practice to employ painter lines having nominal breaking strengths of 500 Kg. But the use of knots may reduce this figure by some 50%. In practice, therefore, breaking strengths of 250 Kg were usual and were insufficient to withstand the upthrust of an inflated raft. In the case of a sinking ship, therefore, a hydrostatically-released raft would be freed by the breaking of its painter line.

More recently, however, much stronger lines have been introduced as one means of preventing the accidental loss of rafts after launching in heavy seas. Painter line assemblies having breaking strengths of 500 and 1000 Kg (according to usage) are now being specified by authorities. Such assemblies demand that painter lines themselves have breaking strengths of 1000 and 2000 Kg. In many cases it is known that such strong lines will not break under the strain imposed by a submerged, inflated raft. Known hydrostatic systems would thus fail in their prime purpose when used in conjunction with the stronger painter-lines since the stronger painter would remain attached to the submerged ship and hold captive the rescue craft. In such circumstances the rescue craft might not reach the surface.

The present invention avoids this problem by providing a hydrostatic release unit which is capable of accommodating high painter strengths for conventional launching purposes but including a "weak link" to ensure that a submerged rescue craft can be released from its painter attachment to a sunken vessel.

Accordingly, in another aspect the invention provides an emergency release system for a rescue craft which incorporates the improved water pressure release mechanism described above and in which a line of lesser breaking strength than the craft's painter has one of its ends attached to the release mechanism and to the painter and its other end attached to the ship, whereby manual release of the rescue craft engages only the painter between the craft and the ship whereas hydrostatic release of the rescue craft engages the weaker line between the painter and the ship.

According to another form of embodiment of the invention the pivot for the eye hook is mounted on a semicylindrical hollow which surrounds the shaft of the eye hook. In this case the following forms of support may be considered: a ring, an arched bushing or a cylinder.

According to another advantageous form of embodiment of the release device according to the invention the hollow is formed in a wall on which are situated the abutment for the shoulder and an attachment flange. By this means it is ensured that forces arising from the painter are transmitted to the ship by means of the hollow, the abutment on the wall or through the attachment flange, so that the water pressure release mechanism itself does not have to accept any tensile forces.

According to another form of embodiment of the invention the eye hook is provided with a lever arm projecting at about 90° to its shaft, which are is arranged below the hook of the water pressure release mechanism and which itself has at its end a shoulder extending substantially in the direction of the shaft of the eye hook. On account of the design of the eye hook as a lever deflection of force is possible and in addition it is ensured that when the hook of the water pressure release mechanism is activated the hook can be released and can pass through the eye aperture of the clamping shackle.

The invention is described in more detail in the following with reference to an example illustrated in the accompanying drawings in which:

FIG. 7 is a perspective view of the release device after manual release of the rescue craft; and FIG. 8 is a perspective view of the release device after hydrostatic release of the rescue craft.

Figure 1:
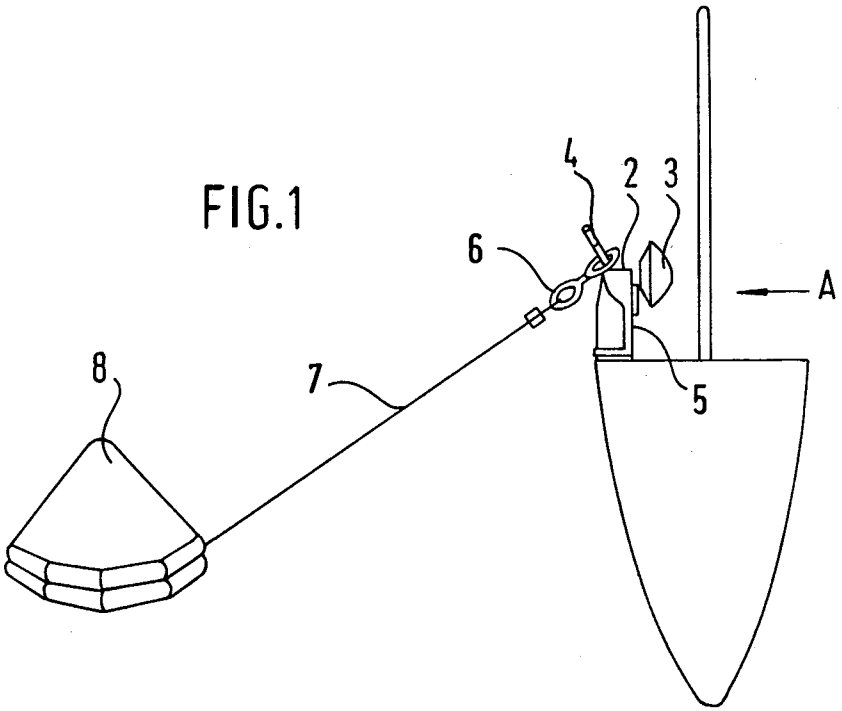
FIG. 1 is a diagrammatic representation of an emergency sea rescue device on a ship where the release device is shown in correct position but on an enlarged scale.

In the Figures a ship is denoted by 1 and a release device denoted as a whole by 2. In the release device 2 the housing 3 of a water pressure release device can be seen, the water pressure release device being known, and including a membrane which releases the locking member of the water pressure release device when a certain water pressure is reached. As is shown schematically in FIG. 1, the release device 2 includes, in addition, an attachment member 5, an eye hook 4 and a clamping shackle 6. On the clamping shackle 6 there is attached a painter 7 which for its part is attached to the rescue craft 8. The latter may, for example, be a collapsible self-inflating liferaft.

Figure 2:
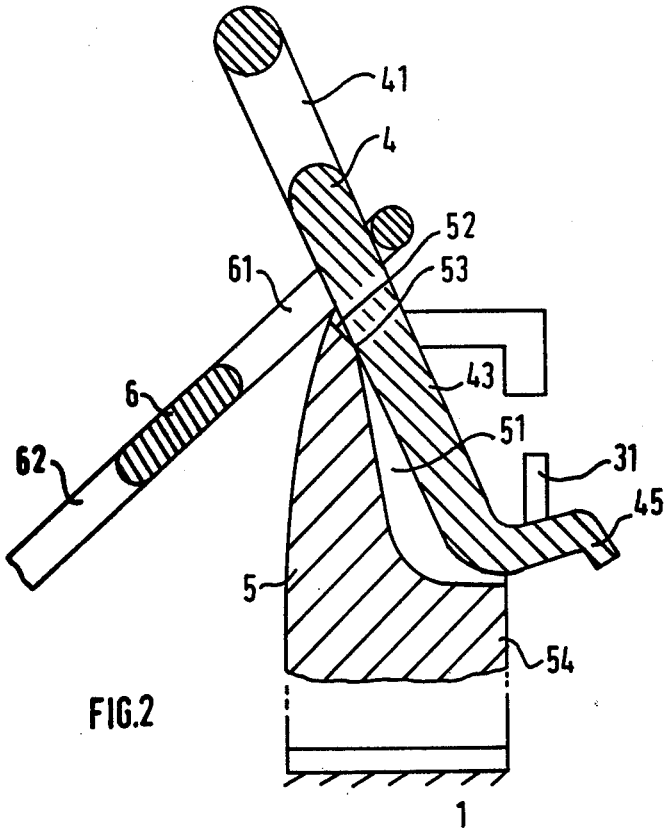
FIG. 2 shows a cross-sectional view through the release device viewed along line II—II of FIG. 4.

In FIG. 2 the attachment member 5 is shown in partial section. At the lower end of the attachment member 5 there is a flange which is firmly fixed to the ship 1 by convenient means, not illustrated. The attachment member 5 includes a recess 51 in the form of a semicircular hollow. At the upper end of the semicircular hollow a bearing surface 52 is formed which, for example, has an oblique or a crowned surface. At the lower end of the hollow 51 there is formed an abutment 54.

Inside the hollow 51 there is situated the eye hook 4, the shaft 43 of which is surrounded by the walls of the hollow. With the type of loading or the direction of the force in the painter as shown in FIG. 2 the shaft 43 of the eye hook 4 is applied at 53 to the bearing surface 52. Correspondingly, the point 53 forms the pivoting point or the fulcrum of the lever for deflection of the force from the painter relative to the force acting on the hook 31 of a, not illustrated, water pressure release mechanism. At its upper end the eye hook 4 has an oval eye aperture 41 in which a strap 42 (see FIG. 3) is attached by any convenient manner and means. The strap 42 serves for the attachment of the rescue craft when not in use. In the drawing the strap 42 is attached to the eye hook 4 by means of any convenient quick-release fastening device.

At its lower end the eye hook 4 has a lever arm 44 projecting approximately at right angles which said arm has a shoulder 45 extending in the direction of the shaft 43. When the forces in the painter are directed upwards the shoulder 45 comes into contact with the abutment 54, so that the forces existing in the painter are not transmitted to the hook 31, but instead are applied through the attachment member 5 to the ship.

The clamping shackle 6 has an eye aperture 61 of oval shape such that the eye aperture 61 surrounds the shaft 43 of the eye hook. The painter 7 is fastened in a convenient manner within the second eye aperture 62 of the clamping shackle 6. In the position illustrated in FIG. 2 the clamping shackle 6 surrounds the shaft 43 of the eye hook immediately above the point 53.

In the situation illustrated in FIG. 1, the strap 42 has already been separated from the rescue craft 8. Further the rescue craft 8 has already been launched on the water while the painter 7 maintains a connection with the ship. As long as the ship 1 remains floating the raft 8 is connected to the ship by the painter 7 and people in the rescue craft 8 can easily be located when a search is made for the ship 1.

Figure 3:
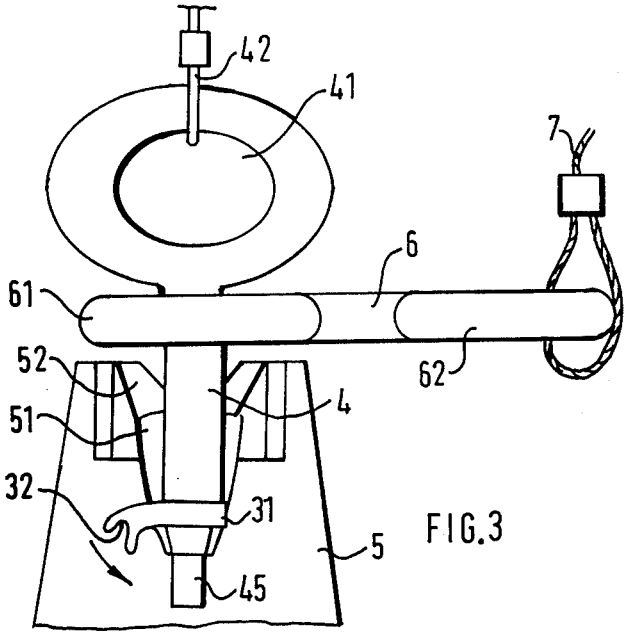
FIG. 3 shows the release device illustrated in FIG. 1 viewed in the direction of arrow A with the housing of the water pressure release mechanism removed.
Figure 4:
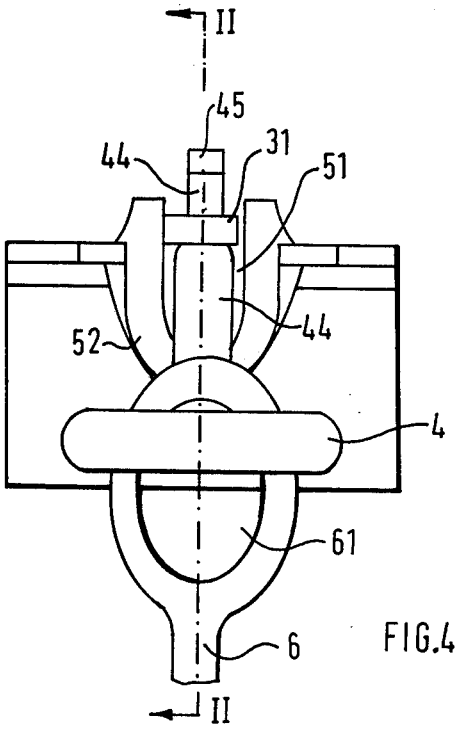
FIG. 4 shows the release device illustrated in FIG. 1 viewed from above.
Figure 5:
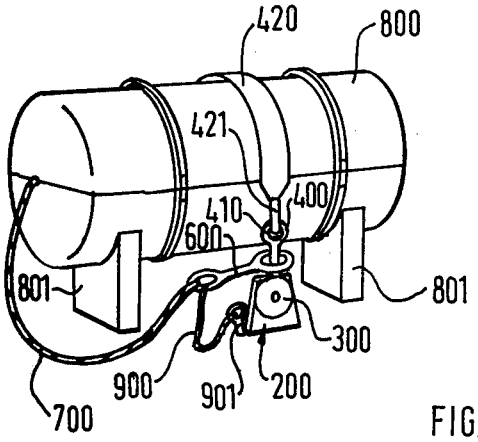
FIG. 5 is a perspective view of a rescue release device which is mounted to include the "weaker line" feature discussed above.

If the ship 1 now sinks, then an increasing force acts on the water pressure release mechanism 3 which finally releases the hook 31, so that with a relatively small upward directed force it is enabled to swivel about its pivoting point 32, shown in FIG. 3, and to release the eye hook. The eye hook 4 with its shaft 43 and lower arm 44 comes out of the eye aperture 61 of the clamping shackle so that in this case the connection between the rescue craft 8 and the ship 1 is broken. The painter 7, which is separated from the ship at the end nearest to the ship, can be hauled into the rescue craft 8 and may possibly serve for the towing of the rescue craft 8.

The eye aperture 61 and 62 of the clamping shackle 6 may be designed to be of equal size so that mistakes during assembly of the release device according to the invention are precluded.

Referring now to FIGS. 5 to 8, there is shown the use of the improved release device of the invention in conjunction with a "weaker line" and a strong painter.

The rescue craft is housed in a rigid container 800 mounted on the deck of a ship in the cradle formed by legs 801. Mounted on and securely attached to the deck between legs 801 is the release device 200. Device 200 is of the type described with reference to FIGS. 1 to 4 and includes water pressure release device 300. An eye hook 400 is hooked at its lower end around the hook (not shown) of the water pressure release device. The eye aperture 410 of eye hook 400 is attached to a restraining strap 420 via a quick release shackle 421. The other end of strap 420 is securely fastened to the ship (not shown). Container 800 is thereby securely held in its cradle.

Figure 6:
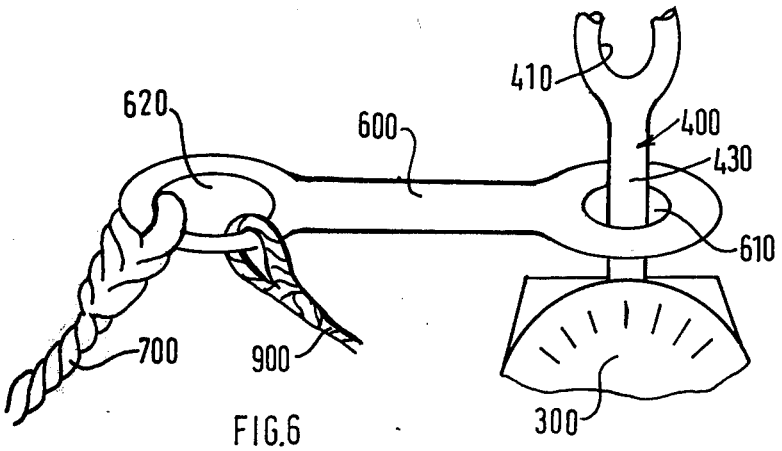
FIG. 6 is an enlarged view of part of FIG. 5 showing the attachment of the weaker line to the painter of the rescue craft.

A clamping shackle 600 has two eye apertures 610 and 620 (see FIG. 6). Eye aperture 610 surrounds shaft 430 of eye hook 400 and is thereby attached to the release device. Painter 700 is attached at one end to eye aperture 620 and at its other end to the rescue craft inside container 800. A line 900, weaker than painter 700, is also attached at one of its ends to eye aperture 620. The other end of line 900 is attached to the ship's deck via eye bolt 901.

Manual release of the rescue craft is illustrated in FIG. 7. Strap 420 has been disengaged from the release device by disengaging shackle 421. The rescue craft has then been removed from its cradle and dropped overboard. It will be seen that painter line 700 remains attached to the release device by the interference of clamping shackle 600. Thus the weaker line 900 remains inoperative and the rescue craft is attached to its parent vessel only by the stronger painter line.

Release of the rescue craft is by means of the hydrostatic release device illustrated in FIG. 8. In a situation where a rescue craft cannot be manually discharged from a sinking vessel it will remain in situ until it is, for example, about 1.8 to 4.5 meters below the surface. At that depth water pressure actuates the water pressure release device. This causes the hook of the water pressure release device to disengage from end 450 of the eye hook 400 thus freeing the eye hook and releasing strap 420. In this situation shaft 430 and end 450 of eye hook 400 pass easily through eye aperture 610 of the clamping shackle 600 and remain attached to strap 420 via shackle 421. Thus the painter 700 and weaker line 900, attached to shackle 600, together constitute the painter line assembly. It will now be apparent that the strength of the assembly is equal only to that of the weaker line 900. It therefore follows that lines calculated to break under any given conditions can be included without reduction of the high painter strength required for manual launching. Furthermore by virtue of the improved, strengthened release device of the invention, more desirable, higher than conventional strength painters can be safely used.

It will be appreciated that modifications to the above specifically-described arrangements can be made without departing from the scope of the invention. For example, it is not essential to use a clamping shackle with two eye apertures. If desired the painter and "weaker line" could be tied to the eye of a single-eye shackle, and that eye could be positioned around the shaft of the eye hook. Alternatively, the clamping shackle could have a single eye and a projection, from the eye, the painter and "weaker line" being tied to the projection.

Having now described my invention what I claim is:

1. Release device suitable for use with an emergency sea rescue apparatus in which a rescue craft is mounted on a ship and is releasably attached to a water pressure release mechanism which releases said craft when a predetermined water pressure is reached, said device comprising an eye hook releasably attachable to said water pressure release mechanism, a clamping shackle which can be attached to a painter attached to said rescue craft and having an opening which encircles the shaft on said eye hook; an attachment member secured to said ship and having an approximately semicircular bearing surface for said eye hook, whereby the clamping shackle can be movable through any angle between about 0° and 180° in the horizontal and vertical directions relative to the shaft of the eye hook and wherein with downward directed forces the eye hook bears against the approximately semicircular bearing surface so as to be capable of pivoting about a bearing point on said attachment member, said eye hook having a shoulder at its lower end which, with upward directed forces, can bear on a fixed abutment on said attachment member and the clamping shackle being positionable on the eye hook immediately above said bearing surface.

2. Release device according to claim 1, in which said opening on the clamping shackle is smaller than the external measurement of the eye of said eye hook.

3. Release device according to claim 1, in which said bearing surface is at the top of said attachment member, said member having a semicylindrical hollow which surrounds the shaft of said eye hook.

4. Release device according to claim 3, in which said hollow is formed by a wall on which is situated the abutment for the shoulder.

5. Release device according to claim 1, in which said eye hook has a lever arm projecting approximately at 90° from its shaft and arranged to fit below the hook of the water pressure release mechanism, on which lever arm there is formed the shoulder extending substantially in the direction of the shaft of the eye hook.

6. An emergency sea rescue apparatus including a rescue craft to be mounted on the deck of a ship, a release device according to claim 1, a painter attached at one end to said rescue craft and at the other end to said release device and a line of lesser breaking strength than said painter, one end of said line being attached to said release device, the other end being securable to the deck of said ship, whereby manual release of the rescue craft engages only the painter between the rescue craft and ship, whereas hydrostatic release of the rescue craft engages the weaker line between the painter and ship.

7. An apparatus according to claim 6, in which said weaker line is attached to said release device via one end of a dumb-bell shaped clamping shackle, the other end of said clamping shackle being releasably attached to the water pressure release device, the painter also being attached to the clamping shackle.

8. An apparatus according to claim 7, in which the painter is attached to the same end of said clamping shackle as is the weaker line.

9. An apparatus according to claim 6, in which the painter has a breaking strength of at least 1000 Kgs and the weaker line has a breaking strength of up to 250 Kgs.

* * * * *